US006148882A

United States Patent [19]

Nettles

[11] Patent Number: 6,148,882

[45] Date of Patent: Nov. 21, 2000

[54] DISK CHIPPER AND METHOD FOR FASTENING A BEDKNIFE TO A DISK CHIPPER

[75] Inventor: Timothy P. Nettles, Carthage, N.Y.

[73] Assignee: Valmet Woodhandling Oy of Pori Finland, Pori, Finland

[21] Appl. No.: 09/498,340

[22] Filed: Feb. 4, 2000

[51] Int. Cl.[7] ..... B27M 3/00; B27L 11/06; B27G 13/00

[52] U.S. Cl. ..... 144/326; 29/446; 29/525.02; 144/162.1; 144/176; 144/363; 409/406.1; 409/409.1; 241/92; 241/291; 241/296

[58] Field of Search ..... 29/446, 525.02; 144/162.1, 176, 329, 172, 173, 174, 363; 403/230, 243, 343, 405.1, 406.1, 409.1; 241/92, 189.1, 273.2, 273.3, 278.1, 291, 296

[56] References Cited

U.S. PATENT DOCUMENTS 4,503,893 3/1985 Demopoulos .
4,685,497 8/1987 Mierau et al. .
5,129,437 7/1992 Nettles et al. .
5,287,901 2/1994 Matthews .
5,857,508 1/1999 Jonkka .

FOREIGN PATENT DOCUMENTS

90/15702 12/1990 WIPO .
98/01272 1/1998 WIPO .

*Primary Examiner*—W. Donald Bray
*Attorney, Agent, or Firm*—Burns, Doane, Swecker & Mathis, L.L.P.

[57] ABSTRACT

A disk chipper includes a bedknife, the bedknife having opposing first and second surfaces, and a chipper frame, the chipper frame having an opening for receiving the bedknife, the opening being defined by opposing first and second surfaces for facing the first and second surfaces of the bedknife, respectively. The disk chipper further includes a wedge, the wedge being movable in a first direction between the second surface of the bedknife and the second surface of the chipper frame to move the first surface of the bedknife in a second direction substantially perpendicular to the first direction toward the first surface of the chipper frame. A method for fastening a bedknife to a disk chipper is also disclosed.

20 Claims, 6 Drawing Sheets

DISK CHIPPER AND METHOD FOR FASTENING A BEDKNIFE TO A DISK CHIPPER

FIELD OF THE INVENTION

The present invention relates to wood chipping apparatus for the pulp and paper industry and, more particularly, to a disk chipper.

BACKGROUND AND SUMMARY

In the pulp and paper industry, the chipping of wood is often performed by means of disk chippers. In a chute-fed disk chipper, such as is seen in FIGS. 1 and 2, the logs (not shown) are fed against a knife disk 13 of the chipper along an inclined feed spout or chute 47 with the aid of gravity. The knife disk 13 rotates around a horizontal axis or around an axis that is inclined, usually at a maximum angle of 20°. To the disk knife 13 are attached, essentially radially, knives 14 that chip the logs against a fixed bedknife 4 located in the lower part of the feed spout. The bedknife is occasionally also referred to as an anvil or a counterblade. The bedknife 4 is subjected to considerable shock forces and must therefore be firmly secured to the chipper frame 29.

During chipping, the logs slide against the bedknife 4 toward the knife disk 13 and wear the bedknife heavily. The wear depends on the number of runs, on the quality of the wood and on the quality and amount of inorganic matter that may occur on the surface of the logs. Because of said wear, the bedknife 4 typically has to be replaced at intervals of 1 to 12 weeks, depending on the circumstances.

A common way of fastening a bedknife 4 to the frame 29 is to use a number of screws 5, 6, 7, and 8 parallel to the axis of the knife disk 13, in a manner similar to the manner shown in FIGS. 1 and 2. In addition, the bedknife 4 is pushed against the framework 29 of the disk chipper from above by means of a screw-on feed spout 47 so that the bedknife is essentially pinched between the feed spout and some other portion of the chipper frame. When the bedknife 4 is to be replaced, it is also necessary to unscrew some (or all) of the fastening screws 12 (FIG. 1) of the feed spout 47 and to raise the feed spout. Before the feed spout 47 can be lowered and fixed into position, the new bedknife 4 has to be set and fixed in place by means of the screws 5–8. Furthermore, the space between the feed spout 47 and the frame 29 must be cleaned carefully. The replacement of a bedknife 4 is hence a relatively laborious and time-consuming operation.

It is desirable to provide a less laborious and time-consuming method for fastening a bedknife in a disk chipper. It is further desirable to provide a disk chipper on which a bedknife is fastenable in a less laborious and time-consuming manner.

In accordance with one aspect of the present invention, a method for fastening a stationary bedknife for a disk chipper to a chipper frame is provided. According to the method, a first surface of a bedknife is positioned relative to a first surface of a chipper frame. A wedge is moved between a second surface of the bedknife opposite the first surface of the bedknife and a second surface of the chipper frame opposite the first surface of the chipper frame so that the bedknife is held in place between the wedge and the first surface of the chipper frame.

In accordance with another aspect of the present invention, a disk chipper includes a bedknife, the bedknife having opposing first and second surfaces, and a chipper frame, the chipper frame having an opening for receiving the bedknife, the opening being defined by opposing first and second surfaces for facing the first and second surfaces of the bedknife, respectively. The disk chipper further includes a wedge, the wedge being movable in a first direction between the second surface of the bedknife and the second surface of the chipper frame to move the first surface of the bedknife in a second direction substantially perpendicular to the first direction toward the first surface of the chipper frame.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
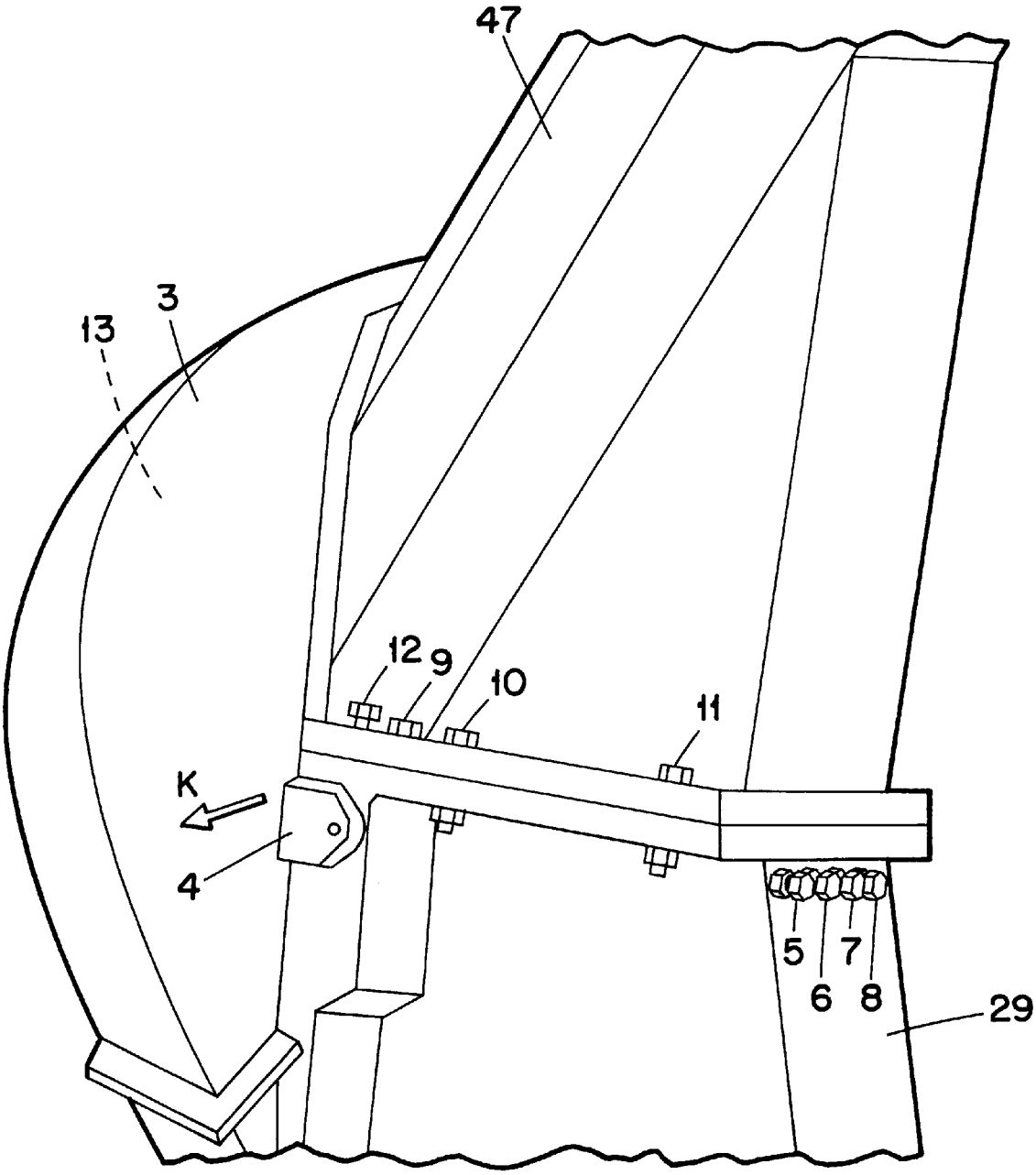
FIG. 1 (PRIOR ART)
FIG. 1 is a perspective view of a bedknife positioned in a disk chipper according to the prior art.

FIG. 1 shows a prior art embodiment including the lower part of a feed spout 47 attached to the frame 29 of a chipper, and a part of a disk hood 3. A bedknife 4 is fastened to the frame in the traditional way by means of screws 5, 6, 7 and 8. On the side shown in FIG. 1, the feed spout 47 is fastened to the frame 29 by bolts or screws 9, 10 and 11; corresponding screws appear on an opposite side of the feed spout. The bedknife 4 is located under the feed spout 47. When the bedknife 23 is to be removed, the bolts 9, 10 and 11 fastening the feed spout 47 to the frame 29 have to be unscrewed first. Besides, the feed spout 47 has to be raised with the aid of a screw 12. Thereafter the four screws 5, 6, 7 and 8, which fasten the bedknife 23 to the frame 29, are unscrewed, after which the bedknife 4 can be pulled away from under the feed spout 47 in the direction indicated by the arrow K. When mounting a new bedknife 4, the steps are taken in reverse order.

Figure 2:
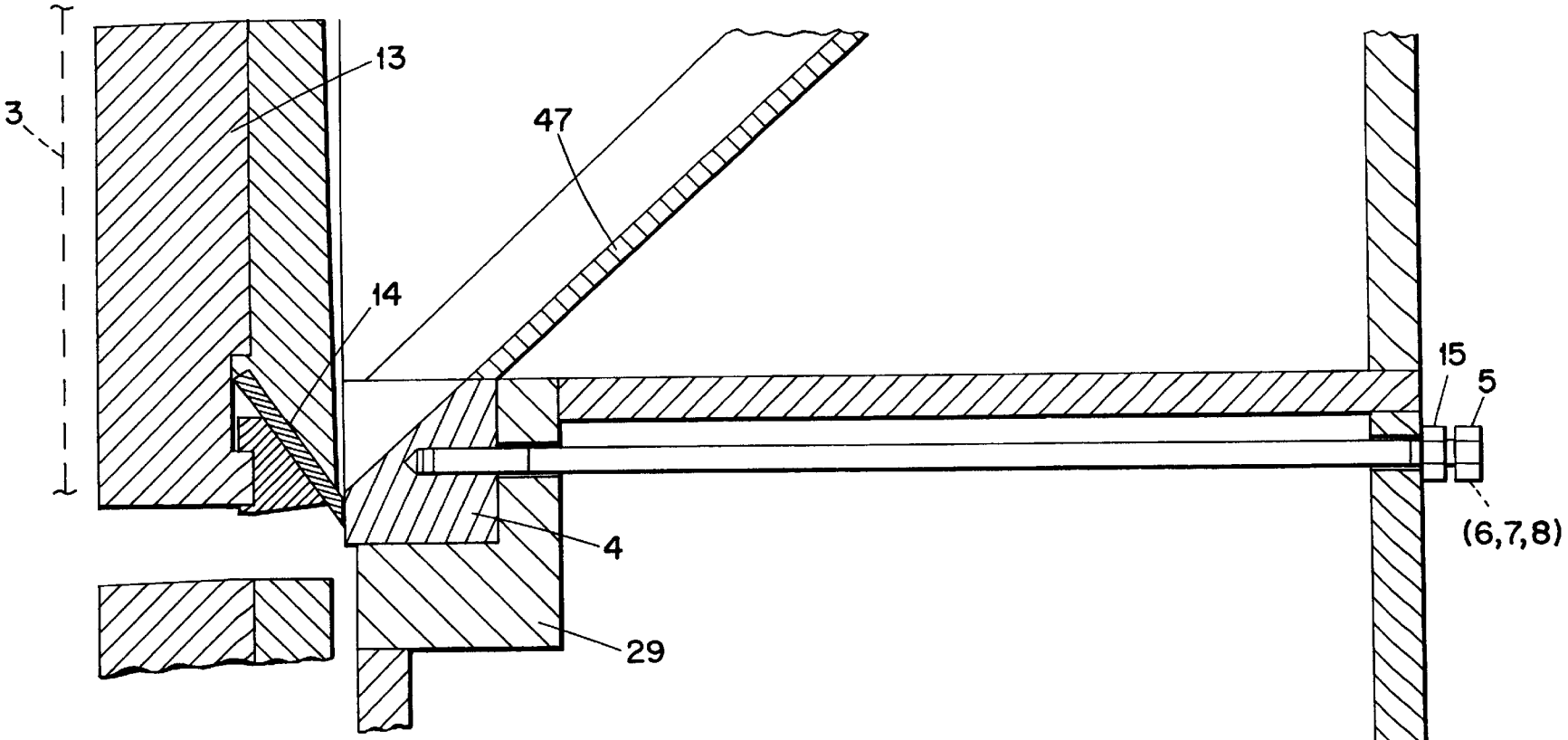
FIG. 2 (PRIOR ART)
FIG. 2 is a side, cross-sectional view of a bedknife fastened in a disk chipper according to the prior art.

FIG. 2 shows the prior art embodiment, corresponding to FIG. 1, including the position of the bedknife 4 fastened between the feed spout 47 and the chipper frame 29. Also shown are the knife disk 13 and a knife 14 fixed thereto. When the screw 5 is to be unscrewed, the locking nut 15 has to be loosened first. Corresponding nuts are provided on screws 6, 7 and 8.

Figure 3:
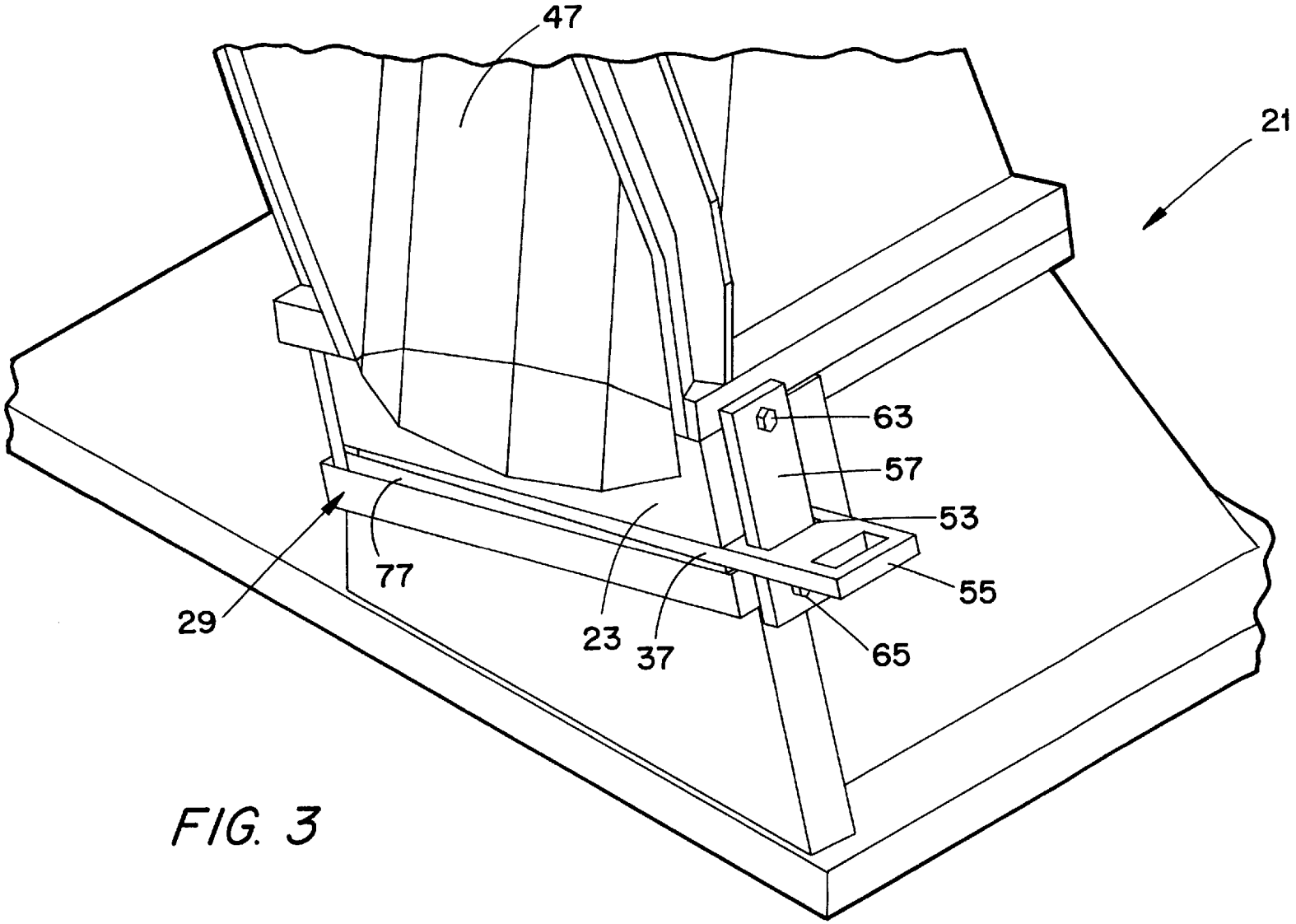
FIG. 3 is a perspective view of a disk chipper according to an embodiment of the present invention.
Figure 4:
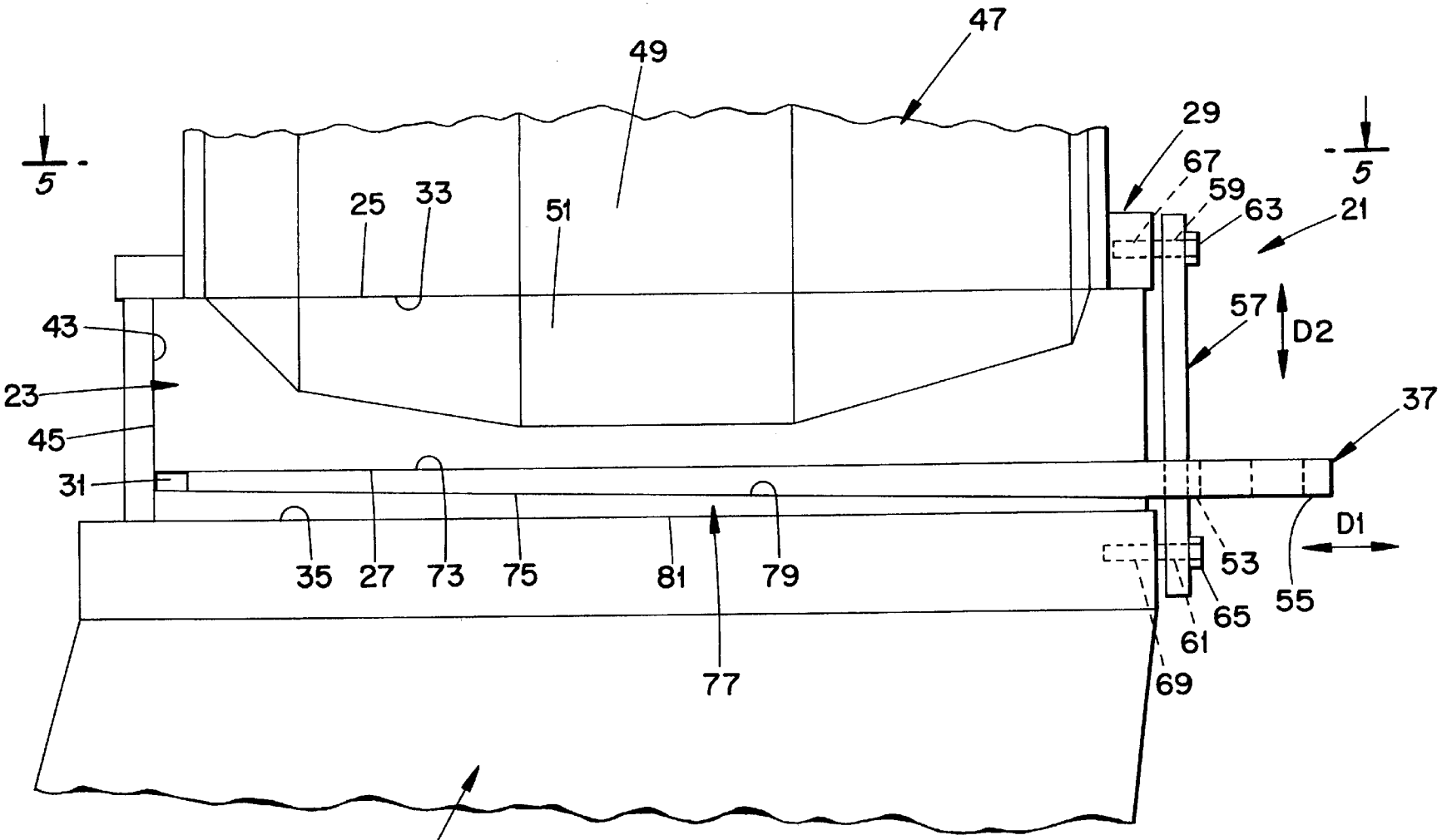
FIG. 4 is a front view of a bedknife fastened to the disk chipper according to an embodiment of the present invention, the bedknife being viewed in a direction of the disk axis and not showing the knife disk.
Figure 5:
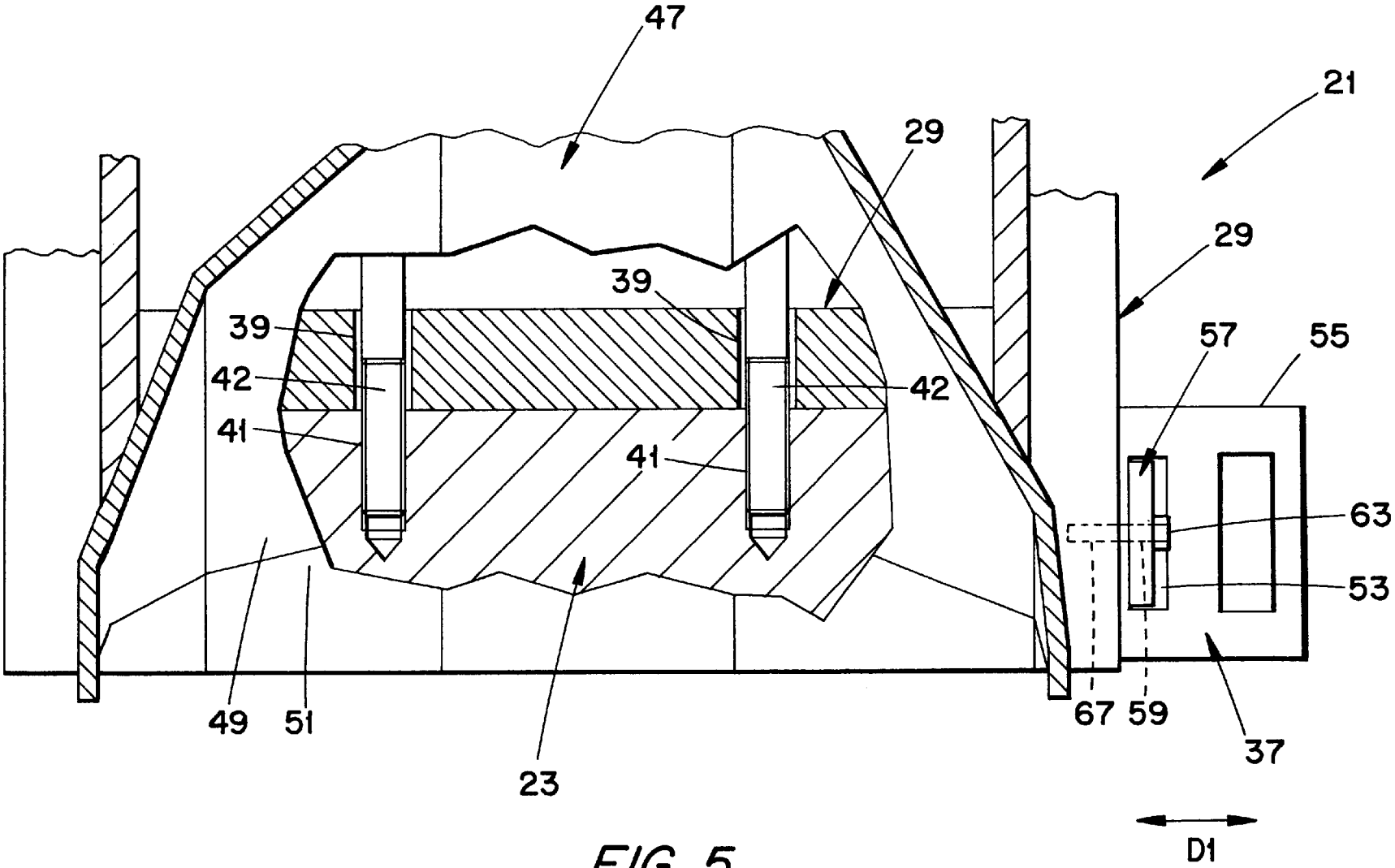
FIG. 5 is a broken, partially cross-sectional top view taken at section 5—5 of FIG. 4;.

Portions of a disk chipper 21 according to an embodiment of the present invention are shown in FIGS. 3, 4 and 5. The disk chipper 21 is preferably substantially the same as the disk chipper shown in FIGS. 1 and 2, except with respect to the method and structure for fastening the bedknife to the disk chipper, and except where otherwise indicated. As seen in FIG. 4, the disk chipper 21 includes a bedknife 23, the bedknife having opposing first and second surfaces 25 and 27. The disk chipper 21 further includes a chipper frame 29, the chipper frame having an opening 31 for receiving the bedknife 23, the opening being defined by opposing first and second surfaces 33 and 35 for facing the first and second surfaces 25 and 27 of the bedknife, respectively. A wedge 37 is provided, the wedge being movable in a first direction D1 between the second surface 27 of the bedknife 23 and the second surface 35 of the chipper frame 29 to move the first surface 25 of the bedknife in a second direction D2 substantially perpendicular to the first direction and toward the first surface 33 of the chipper frame. When the bedknife 23 is being mounted to the chipper frame 29, the wedge 37 is moved in the direction D1 to the left in the embodiment illustrated in FIG. 4, causing the bedknife to move in the direction D2 toward the top of the illustration and, when the bedknife is to be removed, the wedge is moved in the direction D1 to the right in FIG. 4, permitting the bedknife to move in the direction D2 toward the bottom of the illustration.

For purposes of the present application, except where otherwise indicated, the chipper frame 29 is understood to comprise a number of components that are generally stationary relative to each other and that may be integrally connected, bolted together, or simply rigid relative to one another and not connected to each other at all. Surfaces of the wedge 29 may directly contact the chipper frame 29 and the bedknife 23, or may merely face those elements and contact intervening structures, except where otherwise indicated.

As seen in FIG. 5, the chipper frame 29 preferably includes at least one hole 39, preferably a plurality of holes, and the bedknife 23 includes at least one hole 41, preferably a plurality of holes, corresponding to the at least one hole in the chipper frame. The disk chipper 21 includes at least one bolt 42, preferably a plurality of bolts, corresponding to the at least one hole 41 in the bedknife 23 and the at least one hole 39 in the chipper frame 23 for bolting the bedknife in position relative to the chipper frame. Preferably, the at least one bolt 42 is tightened to secure the bedknife 23 in position relative to the chipper frame 29 before the wedge 37 is moved to more securely position the bedknife relative to the chipper frame.

As seen in FIG. 4, the chipper frame 29 preferably has a third surface 43 substantially perpendicular to the first and second surfaces 33 and 35 of the chipper frame, and the bedknife 23 preferably has a third surface 45 substantially perpendicular to the first and second surfaces 25 and 27 of the bedknife. When the bedknife 23 is installed in the opening 31 of the chipper frame 29, the bedknife is moved into the opening until the third surface 45 of the bedknife 23 abuts against the third surface 43 of the chipper frame 29. Preferably, when the third surface 45 of the bedknife 23 abuts against the third surface 43 of the chipper frame, the bedknife is substantially in its intended position relative to the chipper frame. The disk chipper 21 preferably also includes a feed spout 47 as in conventional disk chippers. The feed spout 47 has a lower face 49 and the bedknife 23 has an upper face 51. The upper face 51 of the bedknife 23 is preferably aligned with the lower face 49 of the feed spout 47 when the third surface 45 of the bedknife abuts the third surface 43 of the chipper frame 29.

As seen in FIG. 4, the lower surface of the feed spout 47 by the lower face 49 preferably constitutes some or all of the first surface 33 of the chipper frame 29 against which the first surface 25 of the bedknife 23 abuts although, if desired or necessary, the first surface of the bedknife may abut entirely against a surface of the chipper frame that does not form part of the feed spout. For purposes of the present application, it will be understood that references to the first surface 25 of the bedknife 23 abutting the first surface 33 of the chipper frame 29 include embodiments wherein the first surface of the bedknife abuts against the lower surface of the feed spout 47, embodiments wherein the first surface of the bedknife abuts against the lower surface of the feed spout and other portions of the chipper frame, and embodiments wherein the first surface of the bedknife abuts entirely against portions of the chipper frame separate from the feed spout.

The wedge 37 may be moved relative to the chipper frame 29 in a variety of ways. Preferably, as seen in FIGS. 3, 4, and 5, the wedge 29 includes a hole 53 proximate an end 55 of the wedge. As seen in FIG. 4, a locking piece 57 extends through the hole 53 in the wedge 37 and has holes 59 and 61 provided in portions of the locking piece on opposite sides of the wedge. Positioning screws 63 and 65 extend through the holes 59 and 61 in the locking piece 57 and into threaded holes 67 and 69 in the chipper frame 29. A position of the wedge 37 relative to the chipper frame 29 is adjustable by turning the positioning screws 63 and 65 which, in turn, moves the locking piece 57 which, in turn, moves the wedge 37.

Figure 6:
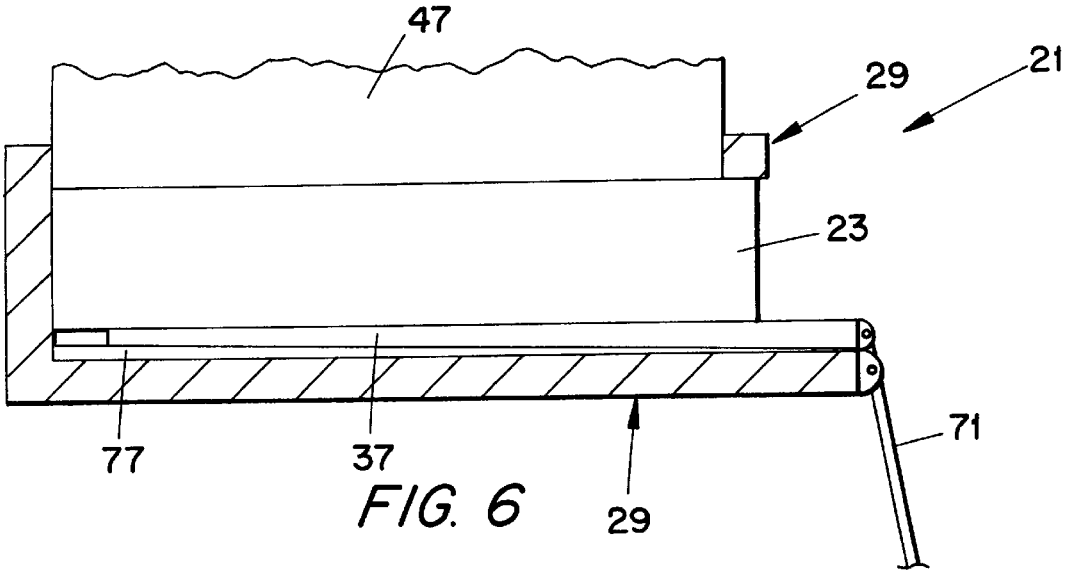
FIG. 6 is a front view of a bedknife fastened to the disk chipper according to another embodiment of the present invention, the bedknife being viewed in a direction of the disk axis and not showing the knife disk.

An alternative structure for moving the wedge 37 is shown in FIG. 6, wherein a lever 71 is pivotably attached to the chipper frame 29 and is adapted to contact the wedge 37 to move the wedge relative to the chipper frame. If desired or necessary, the lever 71 can be pivotably attached to the wedge 37 instead of or in addition to being pivotably attached to the chipper frame 29. Other arrangements for moving the wedge 37, such as hydraulic or pneumatic cylinder arrangements, may be used as desired or necessary.

Figure 7A:
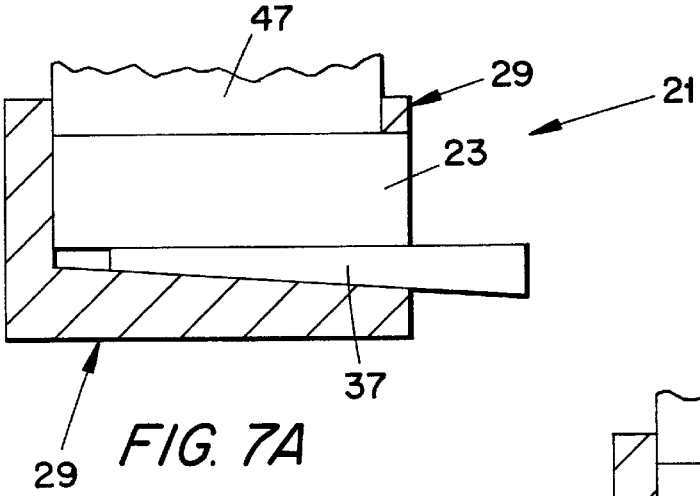
FIGS. 7A, 7B, and 7C are partially cross-sectional, front views of embodiments of wedging arrangements according to the present invention.
Figure 7B:
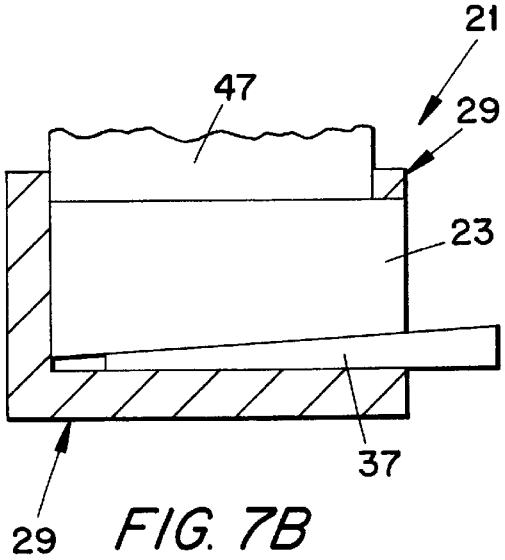
Figure 7C:
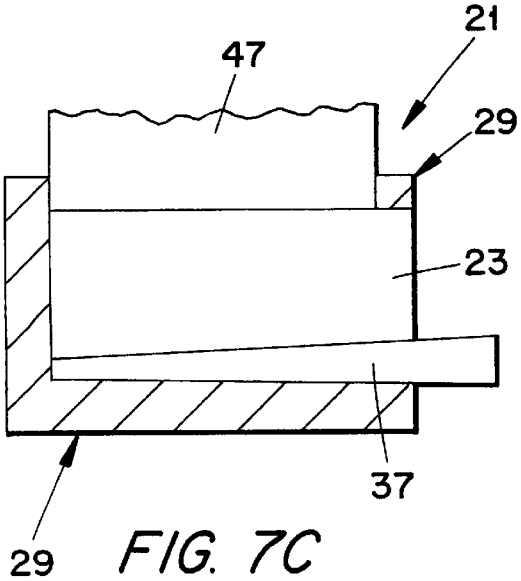

As seen in FIG. 4, the wedge 37 has a first surface 73 and an opposite second surface 75, the first surface of the wedge facing the second surface 27 of the bedknife 23 and the second surface of the wedge facing the second surface 35 of the chipper frame 29. The first and second surfaces 73 and 75 of the wedge 37 are preferably non-parallel, as seen in FIG. 4. Preferably, a counterpart 77 in the form of a member separate from the chipper frame 29 is disposed between the second surface 35 of the chipper frame 29 and the second surface 75 of the wedge 37. The counterpart 77 has a first surface 79 facing the second surface 75 of the wedge 37 and a second surface 81 facing the second surface 35 of the chipper frame 29. Preferably, the first and second surfaces 79 and 81 of the counterpart 77 are non-parallel in a manner corresponding to the manner in which the first and second surfaces 73 and 75 of the wedge 37 are non-parallel. However, if desired or necessary, the counterpart 77 can be omitted or can have parallel first and second surfaces 79 and 81, and the second surface 27 of the bedknife 23 (FIG. 7A) or the second surface 35 of the chipper frame 29 (FIG. 7B) can be angled in a manner corresponding to an angle defined by the non-parallel surfaces of the wedge 37. If desired or necessary, both the second surface 27 of the bedknife 23 and the second surface 35 of the chipper frame 29 can be angled so that the combined angle defined by the angled surfaces corresponds to the angle defined by the non-parallel surfaces of the wedge, as seen in FIG. 7C.

The bedknife 23 is fastened to the chipper frame 29 according to a method wherein the first surface 25 of the bedknife is positioned relative to the first surface 33 of the chipper frame. The wedge 37 is moved between the second surface 27 of the bedknife 23 opposite the first surface of the bedknife and the second surface 35 of the chipper frame 29 opposite the first surface 33 of the chipper frame so that the bedknife is held in place between the wedge and the first surface of the chipper frame. To move the wedge 37, the wedge is preferably moved by tightening positioning screws 63 and 65 to cause the locking piece 57 to move toward the chipper frame 29, and to thereby cause the wedge through which the locking piece extends to move relative to the chipper frame.

Preferably, before moving the wedge 37 between the bedknife 23 and the chipper frame 29, the bedknife is secured in position relative to the first surface 25 of the chipper frame by bolting the bedknife with bolts 42 extending through holes 41 in the chipper frame corresponding to holes 41 in the bedknife. Moreover, because the bedknife 23 preferably includes a third surface 45 substantially perpendicular to the first surface 25 of the bedknife and the chipper frame 29 preferably includes a third surface 43 substantially perpendicular to the first surface of the chipper frame, before tightening the bolts 42, the third surface of the bedknife is preferably positioned relative to the third surface of the chipper frame, such as by being moved into abutment against the third surface of the chipper frame. When the bedknife 23 is held in place between the wedge 37 and the first surface 33 of the chipper frame 29, the upper face 51 of the bedknife is in an operating position relative to the face of the feed spout 47 of the disk chipper.

While this invention has been illustrated and described in accordance with a preferred embodiment, it is recognized that variations and changes may be made therein without departing from the invention as set forth in the claims.

What is claimed is:

1. A method for fastening a stationary bedknife for a disk chipper to a chipper frame, comprising the steps of:

positioning a first surface of a bedknife relative to a first surface of a chipper frame;

moving a wedge between a second surface of the bedknife opposite the first surface of the bedknife and a second surface of the chipper frame opposite the first surface of the chipper frame so that the bedknife is held in place between the wedge and the first surface of the chipper frame.

2. The method as set forth in claim 1, comprising the further step of securing the bedknife in position relative to the first surface of the chipper frame by bolting the bedknife with bolts extending through holes in the chipper frame corresponding to holes in the bedknife.

3. The method as set forth in claim 1, wherein the wedge includes a hole proximate an end of the wedge, a locking piece extends through the hole in the wedge, the locking piece has holes provided in portions of the locking piece on opposite sides of the wedge, and positioning screws extend through the holes in the locking piece and into threaded holes in the chipper frame, the step of moving the wedge including turning the positioning screws.

4. The method as set forth in claim 1, wherein the bedknife includes a third surface substantially perpendicular to the first surface of the bedknife and the chipper frame includes a third surface substantially perpendicular to the first surface of the chipper frame, the method including the further step of positioning the third surface of the bedknife relative to the third surface of the chipper frame.

5. The method as set forth in claim 1, wherein, when the bedknife is held in place between the wedge and the first surface of the chipper frame, an upper face of the bedknife is in an operating position relative to a face of a feed spout of the disk chipper.

6. The method as set forth in claim 1, wherein the wedge has a first surface and an opposite second surface, the first surface of the wedge facing the second surface of the bedknife and the second surface of the wedge facing the second surface of the chipper frame, the step of moving the wedge including moving the wedge in a direction substantially perpendicular to the first and second surfaces of the wedge.

7. The method as set forth in claim 6, wherein the first and second surfaces of the wedge are non-parallel.

8. The method as set forth in claim 7, wherein at least one of the second surface of the bedknife and the second surface of the chipper frame form an angle with the direction of movement of the wedge.

9. A disk chipper, comprising:

a bedknife, the bedknife having opposing first and second surfaces;

a chipper frame, the chipper frame having an opening for receiving the bedknife, the opening being defined by opposing first and second surfaces for facing the first and second surfaces of the bedknife, respectively; and a wedge, the wedge being movable in a first direction between the second surface of the bedknife and the second surface of the chipper frame to move the first surface of the bedknife in a second direction substantially perpendicular to the first direction toward the first surface of the chipper frame.

10. The disk chipper as set forth in claim 9, wherein the chipper frame includes at least one hole and the bedknife includes at least one hole corresponding to the at least one hole in the chipper frame, the disk chipper including at least one bolt corresponding to the at least one hole in the bedknife and the at least one hole in the chipper frame for bolting the bedknife in position relative to the chipper frame.

11. The disk chipper as set forth in claim 9, wherein the chipper frame has a third surface substantially perpendicular to the first and second surfaces of the chipper frame, and the bedknife has a third surface substantially perpendicular to the first and second surfaces of the bedknife, the third surface of the bedknife abutting against the third surface of the chipper frame when the bedknife is in position relative to the chipper frame.

12. The disk chipper as set forth in claim 11, further comprising a feed spout, the feed spout having a face and the bedknife having an upper face, the upper face of the bedknife being aligned with the face of the feed spout when the third surface of the bedknife abuts the third surface of the chipper frame.

13. The disk chipper as set forth in claim 9, wherein the wedge includes a hole proximate an end of the wedge, the disk chipper further comprising a locking piece extending through the hole in the wedge, the locking piece having holes provided in portions of the locking piece on opposite sides of the wedge, and positioning screws extending through the holes in the locking piece and into threaded holes in the chipper frame, a position of the wedge relative to the chipper frame being adjustable by turning the positioning screws.

14. The disk chipper as set forth in claim 9, further comprising a lever pivotably attached to the chipper frame and adapted to contact the wedge to move the wedge relative to the chipper frame.

15. The disk chipper as set forth in claim 9, wherein the wedge has a first surface and an opposite second surface, the first surface of the wedge facing the second surface of the bedknife and the second surface of the wedge facing the second surface of the chipper frame.

16. The disk chipper as set forth in claim 15, wherein the first and second surfaces of the wedge are non-parallel.

17. The disk chipper as set forth in claim 15, further comprising a counterpart disposed between the second surface of the chipper frame and the second surface of the wedge.

18. The disk chipper as set forth in claim 17, wherein the counterpart has a first surface facing the first surface of the wedge and a second surface facing the second surface of the chipper frame.

19. The disk chipper as set forth in claim 18, wherein the first and second surfaces of the counterpart are non-parallel.

20. The disk chipper as set forth in claim 18, wherein the first and second surfaces of the counterpart are parallel.

* * * * *